US009908174B2

(12) United States Patent
Kurosawa et al.

(10) Patent No.: US 9,908,174 B2
(45) Date of Patent: Mar. 6, 2018

(54) CONTINUOUS CASTING DEVICE FOR SLAB COMPRISING TITANIUM OR TITANIUM ALLOY

(71) Applicant: Kobe Steel, Ltd., Hyogo (JP)

(72) Inventors: Eisuke Kurosawa, Kobe (JP); Takehiro Nakaoka, Kobe (JP); Hideto Oyama, Takasago (JP); Hidetaka Kanahashi, Takasago (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 15/718,005

(22) Filed: Sep. 28, 2017

(65) Prior Publication Data

US 2018/0015534 A1 Jan. 18, 2018

Related U.S. Application Data

(62) Division of application No. 15/127,834, filed as application No. PCT/JP2015/058628 on Mar. 20, 2015.

(30) Foreign Application Priority Data

Apr. 15, 2014 (JP) ..... 2014-083532

(51) Int. Cl.
*B22D 11/115* (2006.01)
*B22D 11/041* (2006.01)
(Continued)

(52) U.S. Cl.
CPC ..... *B22D 11/115* (2013.01); *B22D 11/001* (2013.01); *B22D 11/041* (2013.01);
(Continued)

(58) Field of Classification Search
CPC ..... B22D 11/00; B22D 11/04; B22D 11/041; B22D 11/115
(Continued)

(56) References Cited

U.S. PATENT DOCUMENTS 5,273,101 A 12/1993 Lillquist et al.
6,994,835 B2 * 2/2006 Sasatani ..... C30B 11/001 117/81
(Continued)

FOREIGN PATENT DOCUMENTS

EP 2752259 A1 7/2014
EP 2 949 411 A1 12/2015
(Continued)

OTHER PUBLICATIONS

The extended European search report issued by the European Patent Office dated Oct. 13, 2017, which corresponds to European Patent Application No. 15779618.6-1362 and is related to U.S. Appl. No. 15/718,005.
(Continued)

*Primary Examiner* — Kevin E Yoon
(74) *Attorney, Agent, or Firm* — Studebaker & Brackett PC

(57) ABSTRACT

In the present invention the torch movement period is 20-40 seconds, with the torch movement period being the time required to move plasma torches (which heat the surface of molten metal in the casting mold) one time. The average heat input amount at multiple sites, which are obtained by dividing the initial solidification portion (which is where the molten metal makes contact with the casting mold and first solidifies) into multiple sites in the circumferential direction of the casting mold, is 1.0-2.0 MW/m$^2$. The molten metal advection time, which is the time required for electromagnetically stirred molten metal to travel the length of the torch heating region of the surface of the molten metal in the lengthwise direction of the casting mold, is 3.5 seconds or less.

1 Claim, 12 Drawing Sheets

(51) Int. Cl.

| | |
|---|---|
| ***H05H 1/44*** | (2006.01) |
| ***F27D 27/00*** | (2010.01) |
| ***B22D 21/00*** | (2006.01) |
| ***B22D 11/00*** | (2006.01) |

(52) U.S. Cl.
CPC ..... *B22D 21/005* (2013.01); *F27D 27/00* (2013.01); *H05H 1/44* (2013.01)

(58) Field of Classification Search
USPC ..... 164/468, 469, 502–504, 508
See application file for complete search history.

(56) References Cited

U.S. PATENT DOCUMENTS

| | | | | |
|---|---|---|---|---|
| 7,637,307 | B2 | 12/2009 | Jackson et al. | |
| 8,167,024 | B2 | 5/2012 | Kunstreich | |
| 2014/0202654 | A1* | 7/2014 | Nakaoka | B22D 11/115 164/504 |

FOREIGN PATENT DOCUMENTS

| | | | | |
|---|---|---|---|---|
| GB | 2013542 | A | 8/1979 | |
| JP | 3077387 | B2 | 8/2000 | |
| JP | 2013-184173 | A | 9/2013 | |
| WO | 91/00158 | A1 | 1/1991 | |
| WO | WO -2013031431 | A1 * | 3/2013 | B22D 11/115 |
| WO | 2014/115822 | A1 | 7/2014 | |

OTHER PUBLICATIONS

The extended European search report issued by the European Patent Office dated Oct. 13, 2017, which corresponds to European Patent Application No. 15779618.6-1362 and is related to US. Appl. No. 15/718,005.

Malley D.R. et al.; Control of Plasma Hearth Melted Ingot Surfaces; Proceedings of the 10th International Conference on Vacuum Metallurgy, 1990, vol. 1; Jan. 1, 1991; pp. 178-188; Beijing, China.

U.S. Patent and Trademark Office; Manual of Patent Examining Procedure; §2114, Nov. 2015; 2 pp.

U.S. CFR; 128 F.3d 1473 (Fed. Cir. 1997); in Re Schreiber, pp. 1-10.

United States Court of Customs and Patent Appeals; Application of Carl F. Swinehart and Marko Sfiligoj. Patent Appeal No. 8396; Apr. 1, 1971; pp. 1-6.

International Search Report issued in PCT/JP2015/058628; dated Jun. 23, 2015.

Written Opinion issued in PCT/JP2015/058628; dated Jun. 23, 2015.

Malley et al., Control of plasma hearth melted ingot surfaces, Materials and Design, vol. 14, No. 1, pp. 178-188, 1993.

* cited by examiner

TEARING-OFF DEFECT

MOLTEN METAL-COVERING DEFECT EXCELLENT CASTING SURFACE

CONTINUOUS CASTING DEVICE FOR SLAB COMPRISING TITANIUM OR TITANIUM ALLOY

CROSS REFERENCE TO RELATED APPLICATIONS

This application is a Divisional application of U.S. patent application Ser. No. 15/127,834 filed Sep. 21, 2016, which is the U.S. National Phase application of International Patent Application No. PCT/JP2015/058628 filed Mar. 20, 2015, which claims benefit of Japanese Patent Application No. 2014-083532 filed Apr. 15, 2014, the entire contents of which are incorporated herein by reference.

TECHNICAL FIELD

The present invention relates to a continuous casting device for a slab made of titanium or a titanium alloy.

BACKGROUND ART

Continuous casting of an ingot is commonly performed by injecting metal melted by vacuum arc melting or electron beam melting into a bottomless mold and withdrawing the metal downward while being solidified.

Patent Document 1 discloses an automatic control method for plasma melting casting, in which titanium or a titanium alloy is subjected to plasma arc melting in an argon gas atmosphere and injected into a mold for solidification. Performing the plasma arc melting in an inert gas atmosphere, unlike the electron beam melting in vacuum, allows casting of not only pure titanium, but also a titanium alloy.

CITATION LIST

Patent Document

Patent Document 1: Japanese Patent No. 3077387

SUMMARY OF THE INVENTION

Technical Problem

However, if an ingot has irregularities or flaws on a casting surface after casting, a pretreatment, such as cutting the surface, is required before rolling. This causes a reduction in material utilization and an increase in the number of work processes. Thus, there is demand for an ingot casting without causing irregularities or flaws on a casting surface.

An object of the present invention is to provide a continuous casting device for a slab made of titanium or a titanium alloy, capable of casting a slab having an excellent casting surface condition.

Solution to Problem

The present inventors, as a result of trial-and-error attempts to solve the above-mentioned problem, have found that it is possible to cast a slab having an excellent casting surface condition by adjusting a torch moving cycle, an average heat input quantity, and a molten metal advection time within a predetermined numerical value range.

Specifically, the continuous casting device of the present invention is a device for continuously casting a slab made of titanium or a titanium alloy by injecting molten metal prepared by melting titanium or a titanium alloy into a bottomless mold having a rectangular cross section and withdrawing the molten metal downward while being solidified, the device being characterized by comprising:

a plasma torch for heating a melt surface of the molten metal in the mold while moving over the melt surface of the molten metal in a predetermined moving pattern, the plasma torch being disposed above the mold; and an electromagnetic stirring device for stirring at least the melt surface of the molten metal by electromagnetic stirring, the electromagnetic stirring device being disposed on a side of the mold, and by having:

a torch moving cycle T of 20 sec or more and 40 sec or less, the torch moving cycle T being a time required for the plasma torch to complete a single round of movement in the predetermined moving pattern and calculated by $T=4W/(A \cdot Vt)$, where 2W represents a length of a long side of the slab in a horizontal cross section, A represents the number of the plasma torch, and Vt represents an average moving speed of the plasma torch while moving in the predetermined moving pattern;

an average heat input quantity of 1.0 $MW/m^2$ or more and 2.0 $MW/m^2$ or less, the average heat input quantity being obtained by dividing an initial solidification portion, where the molten metal is initially solidified upon contacting with the mold, into a plurality of portions in a peripheral direction of the mold, and calculating an average of heat input quantities to each of the portions in a length direction of the corresponding portion along the mold; and a molten metal advection time Tm of 3.5 sec or less, the molten metal advection time being calculated by $Tm=L/Vm$, where L represents a length of a torch heating region along a long side direction of the mold, the torch heating region being a region of the melt surface of the molten metal, which is heated by the individual plasma torch, and Vm represents an average flow rate of the molten metal while traveling the length L by electromagnetic stirring, and representing a time required for the molten metal to travel the length L of the torch heating region along the long side direction of the mold.

Advantageous Effects of Invention

According to the present invention, the torch moving cycle, a time required for the plasma torch to complete a single round of movement in the predetermined moving pattern, is set to 20 sec or more and 40 sec or less. This can reduce nonuniformity caused by a temporal change and a spatial variation in heat input quantities to the melt surface of the molten metal due to a movement of the plasma torch. Further, the average heat input quantity to the individual portion resulting from dividing the initial solidification portion into the plurality of portions in the peripheral direction of the mold is set to 1.0 $MW/m^2$ or more and 2.0 $MW/m^2$ or less. This can reduce the nonuniformity in the heat input quantities over the entire periphery of peripheral parts of the melt surface of the molten metal. Finally, the molten metal advection time representing a time required for the molten metal to travel the length of the torch heating region along the long side direction of the mold is set to 3.5 sec or less. This can uniformize surface temperatures of the slab. By uniformizing the heat input quantities over the entire periphery of the peripheral parts of the melt surface of the molten metal in this manner, it becomes possible to cast the slab having an excellent casting surface condition.

DESCRIPTION OF EMBODIMENTS

Hereinafter, preferred embodiments of the present invention will be described with reference to the drawings.

(Configuration of Continuous Casting Device)

Figure 1:
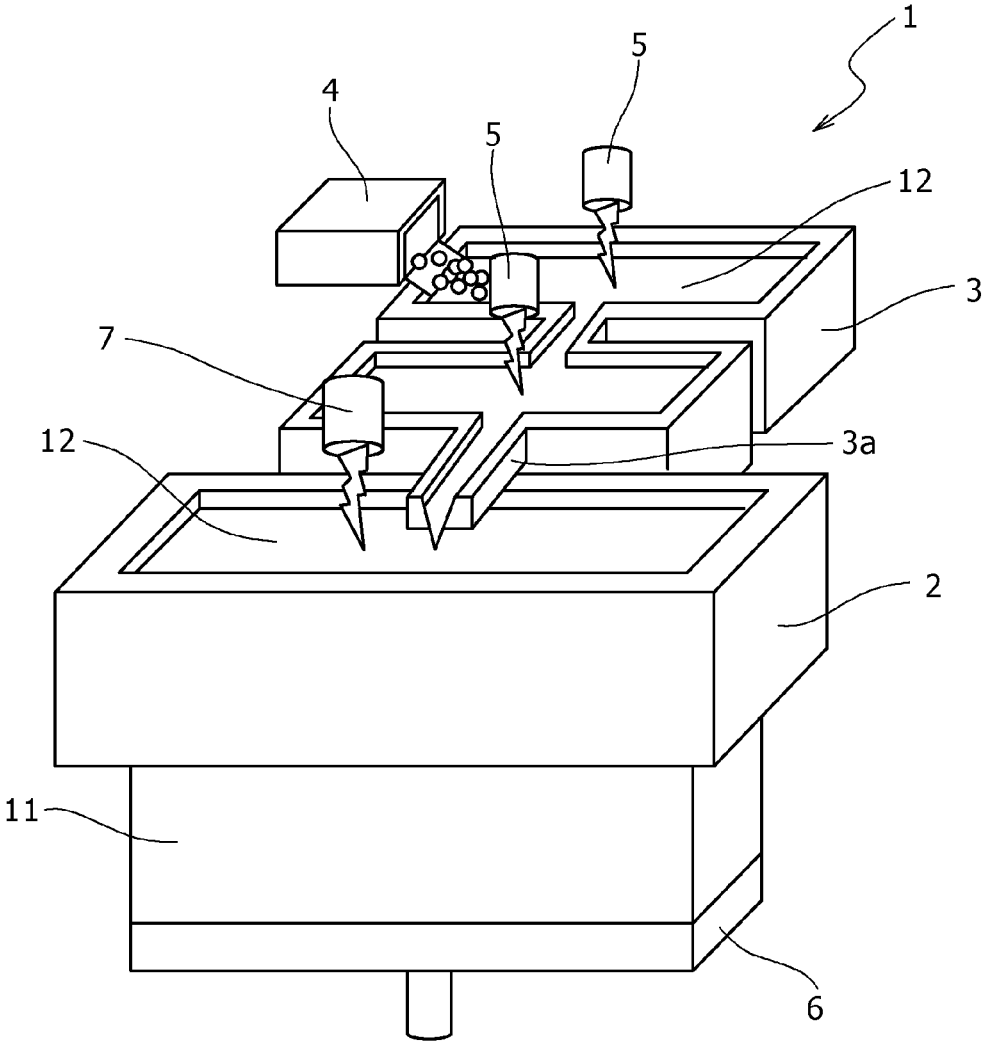
FIG. 1 is a perspective view of a continuous casting device.
Figure 2:
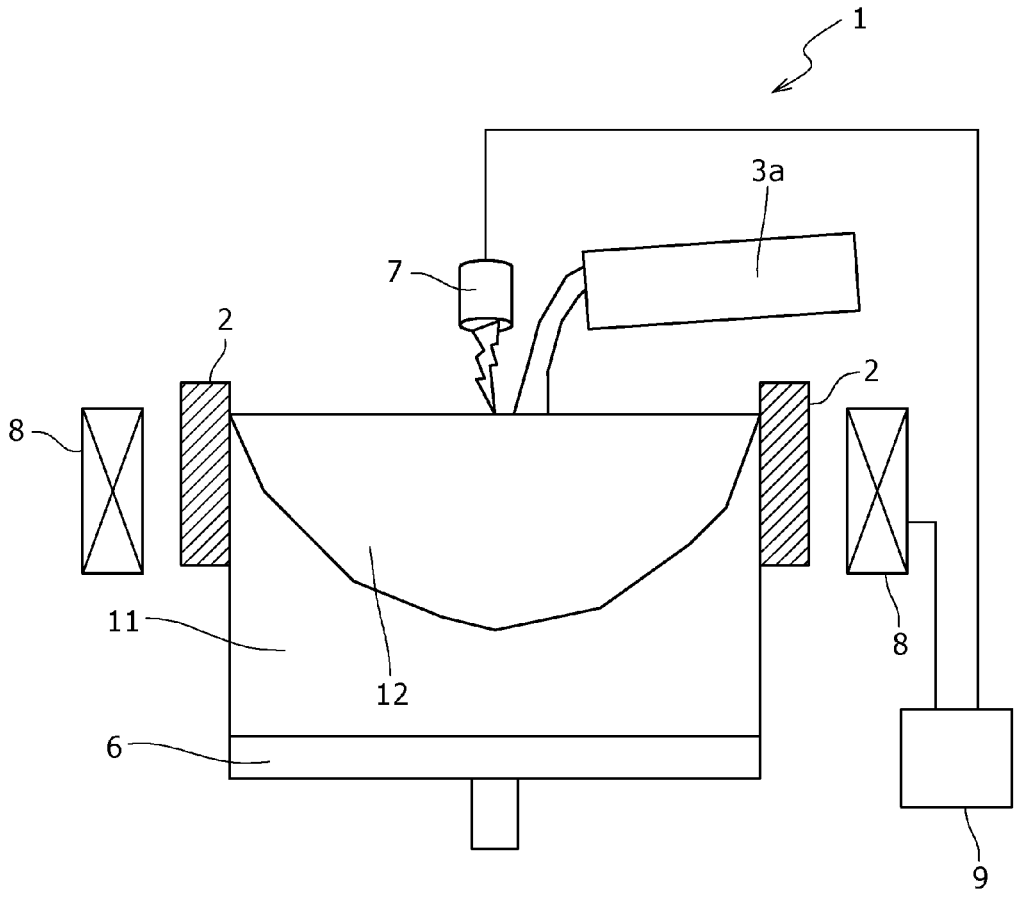
FIG. 2 is a cross-section view of the continuous casting device.

A continuous casting device (continuous casting device) 1 for a slab made of titanium or a titanium alloy according to the present embodiment is a continuous casting device for continuously casting a slab made of titanium or a titanium alloy by injecting molten metal of titanium or a titanium alloy subjected to plasma arc melting into a bottomless mold having a rectangular cross section and withdrawing the molten metal downward while being solidified. This continuous casting device 1 comprises, as shown in FIG. 1 as a perspective view and FIG. 2 as a cross-section view, a mold 2, a cold hearth 3, a source charging device 4, a plasma torch 5, a starting block 6, and a plasma torch 7, an electromagnetic stirring device 8, and a controller (controlling device) 9. It is noted that the electromagnetic stirring device 8 and the controller 9 are not shown in FIG. 1. The continuous casting device 1 is surrounded by an inert gas atmosphere containing argon gas, helium gas, and the like.

The source charging device 4 supplies a source of titanium or a titanium alloy, such as sponge titanium and scrap, into the cold hearth 3. The plasma torch 5 is disposed above the cold hearth 3 and melts the source inside the cold hearth 3 by generating plasma arcs. The cold hearth 3 injects molten metal 12 having the source melted into the mold 2 from an injecting portion 3*a* at a predetermined flow rate.

The mold 2 is made of copper and formed in a bottomless shape having a rectangular cross section. At least a part of a wall portion of the mold 2 formed in a rectangular cylindrical shape is configured to circulate water inside the wall portion for cooling. The starting block 6 is movable in an up and down direction by a drive portion not shown, and able to block a lower side opening of the mold 2. The plasma torch 7 is disposed above the mold 2 and configured to move above a melt surface of molten metal 12 in a predetermined moving pattern by a moving means not shown, thereby heating the melt surface of the molten metal 12 injected into the mold 2 by plasma arcs. The controller 9 controls the movement of the plasma torch 7.

The electromagnetic stirring device 8 is a device having a coil iron core wound by an EMS coil and disposed on a side of the mold 2. It stirs at least the melt surface of the molten metal 12 inside the mold 2 by electromagnetic stirring driven by alternating current. The controller 9 controls the electromagnetic stirring of the electromagnetic stirring device 8.

In the foregoing configuration, solidification of the molten metal 12 injected into the mold 2 begins from a contact surface between the molten metal 12 and the mold 2 having a water-cooling system. Then, as the starting block 6 blocking the lower side opening of the mold 2 is lowered at a predetermined speed, a slab 11 in a rectangular cylindrical shape formed by solidifying the molten metal 12 is continuously cast while being withdrawn downward from the mold 2.

In this process, it is difficult to cast a titanium alloy using electron beam melting in a vacuum atmosphere since trace components in the titanium alloy would evaporate. In contrast, it is possible to cast not only pure titanium, but also a titanium alloy using plasma arc melting in an inert gas atmosphere.

Further, the continuous casting device 1 may comprise a flux supplying device for supplying flux in a solid phase or a liquid phase to the melt surface of the molten metal 12 inside the mold 2. In this process, it is difficult to supply the flux to the molten metal 12 inside the mold 2 using the electron beam melting in a vacuum atmosphere since the flux would be scattered. In contrast, the plasma arc melting in an inert gas atmosphere has an advantage of being able to supply the flux to the molten metal 12 inside the mold 2.

(Operational Conditions)

When a slab 11 made of titanium or a titanium alloy is continuously cast, irregularities or flaws generated on a surface of the slab 11 (casting surface) would cause a surface defect in a next rolling process. Thus, such irregularities or flaws on the surface of the slab 11 must be removed before rolling by cutting or the like. However, this would decrease material utilization and increase the number of work processes, thereby causing an increase in cost. As such, there is demand for the casting of the slab 11 without causing irregularities or flaws on the casting surface.

Figure 3A:
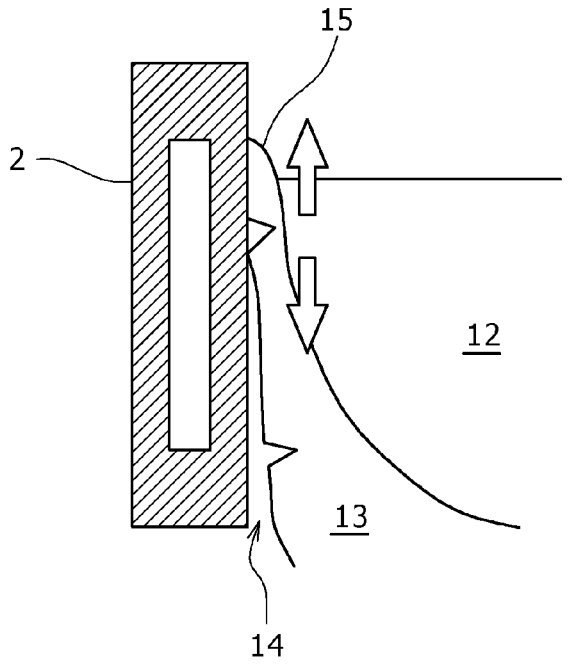
FIG. 3A is an explanatory diagram illustrating a causing mechanism of a surface defect.
Figure 3B:
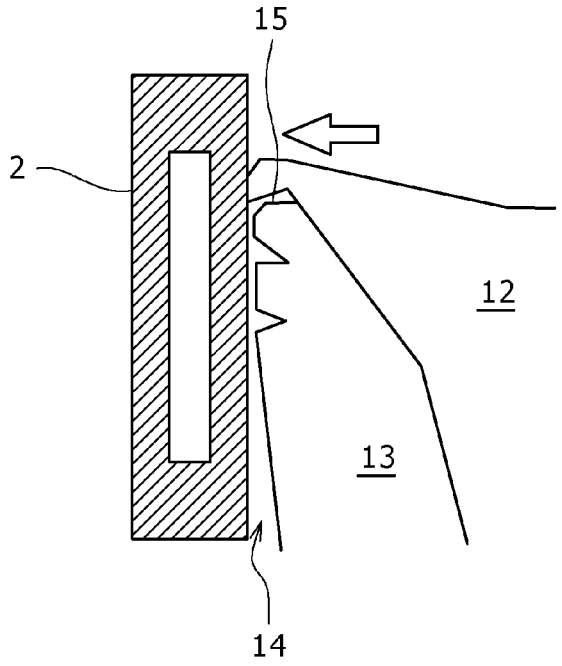
FIG. 3B is an explanatory diagram illustrating a causing mechanism of a surface defect.

FIG. 3A and FIG. 3B are explanatory diagrams each illustrating a causing mechanism of a surface defect. In the vicinity of a border between the mold 2 and the molten metal 12, the mold 2 contacts with a surface of a solidified shell 13 only near the melt surface of the molten metal 12 (a region extending from the melt surface to an about 10 mm depth) that is heated by the plasma arcs or the electron beam. In a region deeper than this contact region, the slab 11 undergoes thermal shrinkage, thus an air gap 14 is generated between the slab 11 and the mold 2. Then, as shown in FIG. 3A, if a heat input is excessive to an initial solidification portion 15 (a portion of the molten metal 12 initially solidified by contacting to the mold 2) located in periphery parts of the melt surface of the molten metal 12, the solidified shell 13 becomes too thin and falls short of strength, thereby causing a "tearing-off defect", in which a surface portion of the solidified shell 13 is torn off. On the other hand, as shown in FIG. 3B, if the heat input to the initial solidification portion 15 is not sufficient, there occurs a "molten metal-covering defect", in which the solidified shell 13 that has grown (become thick) is covered with the molten metal 12.

Figure 4A:
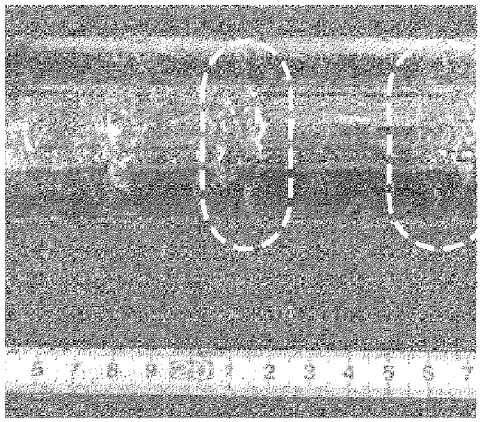
FIG. 4A is an image of a slab surface.
Figure 4B:
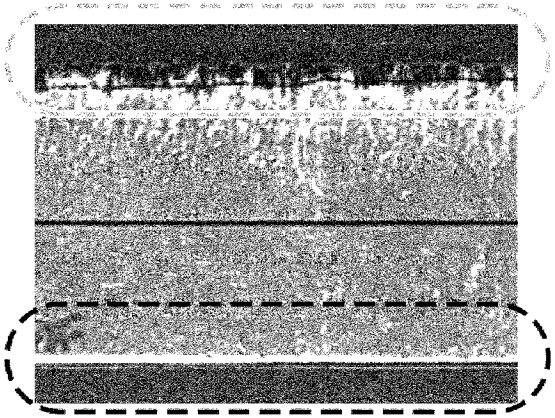
FIG. 4B is an image of a slab surface.

Images of ingot surfaces having the "tearing-off defect" and the "molten metal-covering defect" are shown in FIG. 4A and FIG. 4B, respectively.

Thus, it is speculated that a heat input/output condition applying to the initial solidification portion 15 near the melt surface of the molten metal 12 would have a great impact on a casting surface condition. Accordingly, it is expected that the slab 11 having an excellent casting surface can be obtained by appropriately controlling the heat input/output condition applying to the initial solidification portion 15 near the melt surface of the molten metal 12.

Figure 5A:
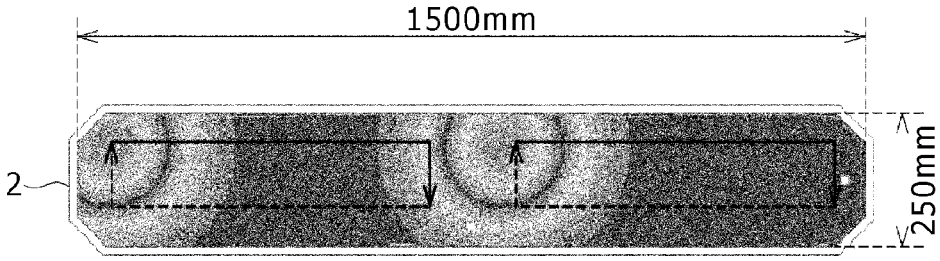
FIG. 5A is a model diagram of a mold, seen from above.
Figure 5B:
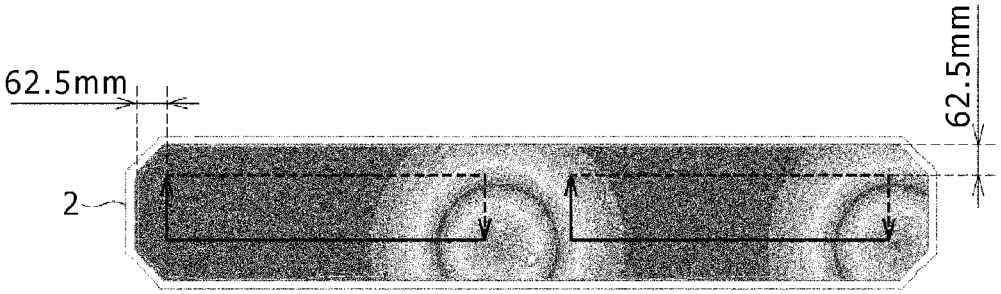
FIG. 5B is a model diagram of the mold, seen from above.

However, as shown in FIG. 5A and FIG. 5B, each depicting a model diagram of the mold 2 seen from above, when the slab 11 having a large size of, for example, 250×1500 mm is continuously cast by the plasma arc melting, there is a limitation to a heating range of the plasma torch 7. Thus, heating the entire melt surface requires a plurality of the plasma torches 7 having a large output. In FIG. 5A and FIG. 5B, two plasma torches 7 having a large output are used. Further, since the slab 11 is thick, the plasma torch 7 needs to be rotationally moved along the mold 2 in order to suppress the growth of the solidified shell 13 at short side and corner parts of the mold 2. Arrows in FIG. 5A and FIG. 5B indicate a moving route of the plasma torch 7. Each of the plasma torches 7 turns clockwise about 62.5 mm inside from a mold wall of the mold 2. The output of each plasma torch 7 is, for example, 750 kW.

Since a staying time of the plasma torch 7 at long side parts of the mold 2 is long, the heat input to the initial solidification portion 15 becomes large, resulting in forming the thin solidified shell 13. On the other hand, the staying time of the plasma torch 7 at the short side and the corner parts of the mold 2 is short, thus the heat input to the initial solidification portion 15 becomes insufficient, and accordingly, the solidified shell 13 has grown (become thick). Consequently, the solidification takes place unevenly depending on a position of the slab 11, leading to deterioration of the casting surface condition.

Figure 6:
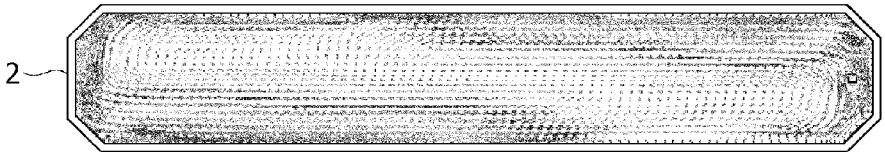
FIG. 6 is a model diagram of a mold, seen from above.

Thus, as shown in FIG. 6 depicting a model diagram of the mold 2 seen from above, an electromagnetic stirring device 8, not shown, is disposed on a side of the mold 2 and used to stir at least the melt surface of the molten metal 12 inside the mold 2 by electromagnetic induction. By electromagnetic stirring caused by the electromagnetic stirring device 8, a horizontally rotating flow (turning flow) is generated on or near the melt surface of the molten metal 12. By this turning flow, the molten metal 12 having a higher temperature, residing at the long side parts of the mold 2, is transferred to the short side and the corner parts of the mold 2, where the solidified shell 13 tends to grow. This mitigates temperature rise of the molten metal 12 at the long side parts of the mold 2, where the plasma torch 7 stays longer, and temperature drop of the molten metal 12 at the short side and the corner parts of the mold 2, where the plasma torch 7 stays shorter.

It is noted that a direction of the turning flow at least on the melt surface of the molten metal 12 may be the same as the turning direction of the plasma torch 7 or a direction opposite thereto. However, turning at least the melt surface of the molten metal 12 in a direction opposite to the turning direction of the plasma torch 7 can reduce a fluctuation range in a surface temperature of the slab 11.

When the slab 11 having a large size is continuously cast, it is required to accelerate a flow rate of the molten metal 12 by a strong stirring force in order to transfer heat to the entire melt surface by the electromagnetic stirring.

Figure 7A:
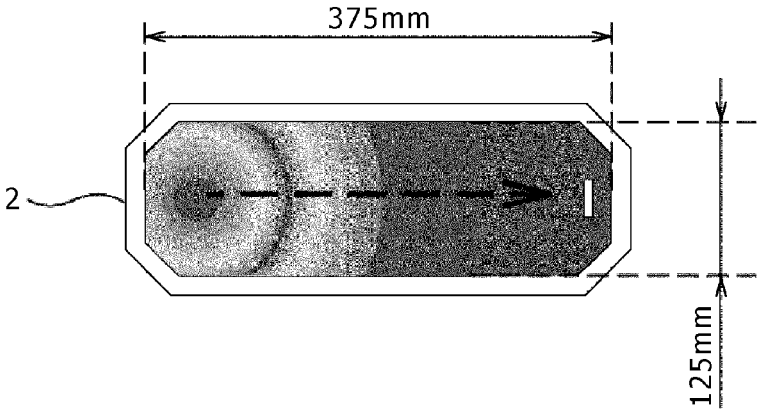
FIG. 7A is a model diagram of a mold, seen from above.
Figure 7B:
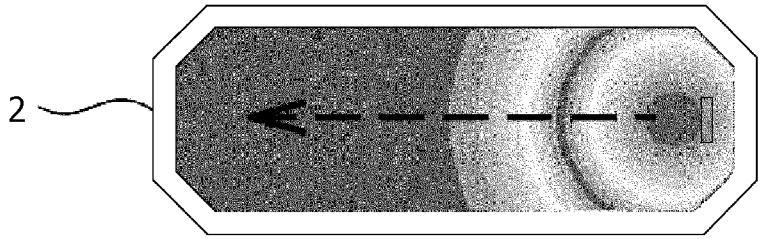
FIG. 7B is a model diagram of the mold, seen from above.

On the other hand, as shown in FIG. 7A and FIG. 7B, each depicting a model diagram of the mold 2 seen from above, when the slab 11 having a small size of, for example, 125×375 mm is continuously cast by the plasma arc melting, the entire melt surface can be heated by a single plasma torch 7 small in output owing to a small area of the melt surface. Further, since the slab 11 is thin, the growth of the solidified shell 13 can be suppressed at the short side and the corner parts of the mold 2 by reciprocating the plasma torch 7 on the same line. It is noted that arrows in FIG. 7A and FIG. 7B indicate a moving route of the plasma torch 7. The output of the plasma torch 7 is, for example, 200 to 250 kW.

Figure 8:
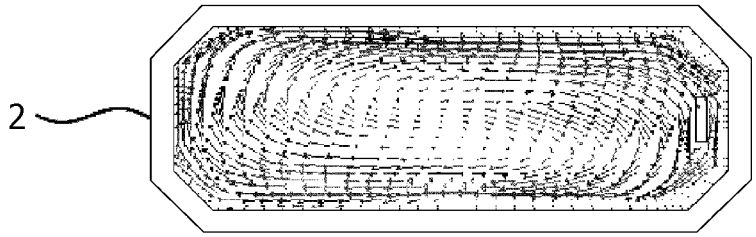
FIG. 8 is a model diagram of a mold, seen from above.

Further, as shown in FIG. 8 depicting a model diagram of the mold 2 seen from above, when the slab 11 having a small size is continuously cast, the heat can be still transferred to the entire melt surface by the turning flow of the molten metal 12 having a slow flow rate due to a weak stirring force of the electromagnetic stirring.

As described above, the number, an output, and a moving pattern of the plasma torch 7 required for smoothing a casting surface depend on the size of the slab 11 to be cast. Further, the stirring force of the electromagnetic stirring required for smoothing a casting surface depends on the size of the slab 11 to be cast.

On the basis of the premise above, the present inventors, as a result of trial-and-error attempts to cast the slab 11 having an excellent casting surface condition, have found that it is possible to cast the slab 11 having an excellent casting surface condition by adjusting a torch moving cycle, an average heat input quantity, and a molten metal advection time within a predetermined numerical value range.

Specifically, it was found that the slab 11 having an excellent casting surface condition can be cast by adjusting the torch moving cycle to 20 sec or more and 40 sec or less, the average heat input quantity to 1.0 $MW/m^2$ or more and 2.0 $MW/m^2$ or less, and the molten metal advection time to 3.5 sec or less.

(Torch Moving Cycle)

The torch moving cycle is a time required for the plasma torch 7 to complete a single round of movement in a predetermined moving pattern over the melt surface. Specifically, the torch moving cycle is obtained by dividing a moving distance of the plasma torch 7 per round by an average moving speed of the plasma torch 7.

As shown in FIG. 5A and FIG. 5B, when the slab 11 having a large size is cast, two plasma torches 7 are each rotationally moved at a predetermined speed over the melt surface. The torch moving cycle is a time required for the plasma torch 7 to complete one rotation. Further, as shown in FIG. 7A and FIG. 7B, when the slab 11 having a small size is cast, the plasma torch 7 is reciprocally moved at a predetermined speed over the melt surface. The torch moving cycle is a time required for the plasma torch 7 to complete one reciprocating motion.

Figure 9:
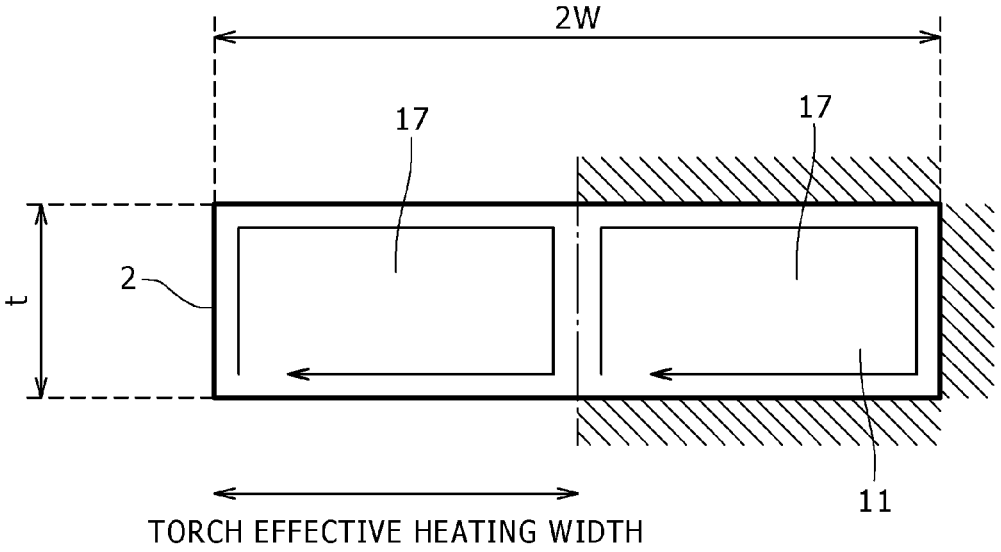
FIG. 9 is a model diagram of a mold, seen from above.
Figure 10:
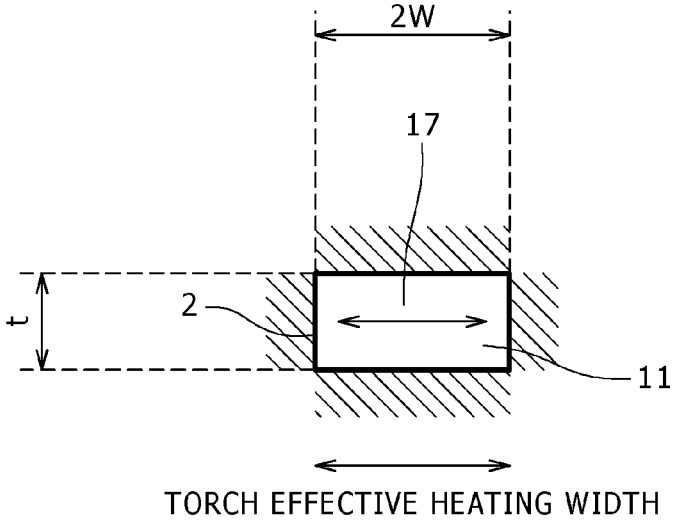
FIG. 10 is a model diagram of a mold, seen from above.

As shown in FIG. 9 and FIG. 10, each depicting a model diagram of the mold 2 seen from above, a length of the long side of the slab 11 in a horizontal cross section (slab width) is denoted as 2W. It is noted that the mold 2 shown in FIG. 9 is for casting the slab 11 having a large size, and corresponds to the mold 2 shown in FIG. 5A and FIG. 5B. On the other hand, the mold 2 shown in FIG. 10 is for casting the slab 11 having a small size, and corresponds to the mold 2 shown in FIG. 7A and FIG. 7B. Further, the torch moving cycle T is calculated by $T=4W/(A \cdot Vt)$, where A represents the number of the plasma torch 7 and Vt represents an average moving speed of the plasma torch 7 while moving in the predetermined moving pattern.

As shown in FIG. 5A, FIG. 5B, FIG. 7A, and FIG. 7B, when an attention is paid to a given location on the melt surface of the molten metal 12, the movable plasma torch 7 is moving toward and away from that location. Thus, a heat input quantity to the given location changes over time. Further, when an attention is paid to the entire melt surface of the molten metal 12, a location near the plasma torch 7, thus having a high heat input quantity and a location far from the plasma torch 7, thus having a low heat input quantity change as the plasma torch 7 moves. Consequently, the movement of the plasma torch 7 causes a temporal change and a spatial variation in the heat input quantity to the melt surface of the molten metal 12, thereby generating nonuniformity in the heat input quantity.

However, the nonuniformity caused by the temporal change and the spatial variation in the heat input quantity to the melt surface of the molten metal 12 can be reduced by setting the torch moving cycle T to 20 sec or more and 40 sec or less.

(Flow and Solidification Calculation)

The torch moving cycle T was calculated by flow and solidification calculation in order to obtain the slab 11 having an excellent casting surface over the entire periphery. The result is shown in Table 1.

TABLE 1

| Slab width 2W[mm] | Number of plasma torch A[—] | Average moving speed Vt[mm/sec] | Torch moving cycle T[sec] |
|---|---|---|---|
| 750 | 1 | 50 | 30 |
| 1000 | 1 | 50 | 40 |
| 1000 | 2 | 50 | 20 |
| 1250 | 2 | 50 | 25 |
| 1500 | 2 | 50 | 30 |

A maximum value of the average moving speed Vt is about 50 mm/sec. Further, it is estimated that a limit value of the slab width up to which the single plasma torch 7 can be used for casting is about 1000 mm. Based on these, it was found that the slab 11 having an excellent casting surface over the entire periphery could be obtained by setting the torch moving cycle T to 20 sec or more and 40 sec or less.

(Average Heat Input Quantity)

The average heat input quantity is obtained by dividing the initial solidification portion 15 (a portion where the molten metal 12 is initially solidified upon contacting with the mold 2) (see FIG. 3A and FIG. 3B) into a plurality of portions in a peripheral direction of the mold 2, and calculating an average of heat input quantities to each of the portions in a length direction of the corresponding portion along the mold 2.

Figure 11:
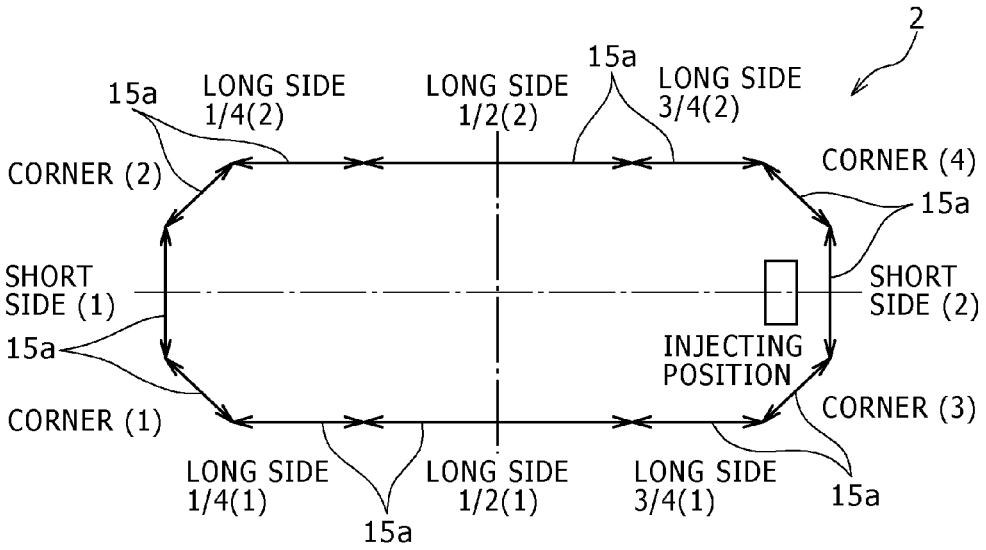
FIG. 11 is a model diagram of a mold, seen from above.

In the present embodiment, as shown in FIG. 11 depicting a model diagram of the mold 2 seen from above, the initial solidification portion 15 is divided into a total of twelve portions 15*a* along the inner periphery of the mold 2, consisting of corners (1) to (4), long sides ¼ (1) and (2), long sides ½ (1) and (2), long sides ¾ (1) and (2), and short sides (1) and (2). Then the average heat input quantity is obtained in each of the portions 15*a*.

As mentioned above, the growth of the solidified shell 13 near the melt surface of the molten metal 12 is significantly influenced by the heat input condition to the initial solidification portion 15. As shown in FIG. 3A, if the heat input to the initial solidification portion 15 is excessive, the "tearing-off defect" occurs. On the other hand, as shown in FIG. 3B, if the heat input to the initial solidification portion 15 is not sufficient, the "molten metal-covering defect" occurs.

However, the nonuniformity in the heat input quantity over the entire periphery of peripheral parts of the melt surface of the molten metal 12 can be reduced by setting the average heat input quantity to 1.0 MW/m$^2$ or more and 2.0 MW/m$^2$ or less.

(Flow and Solidification Calculation)

Figure 12:
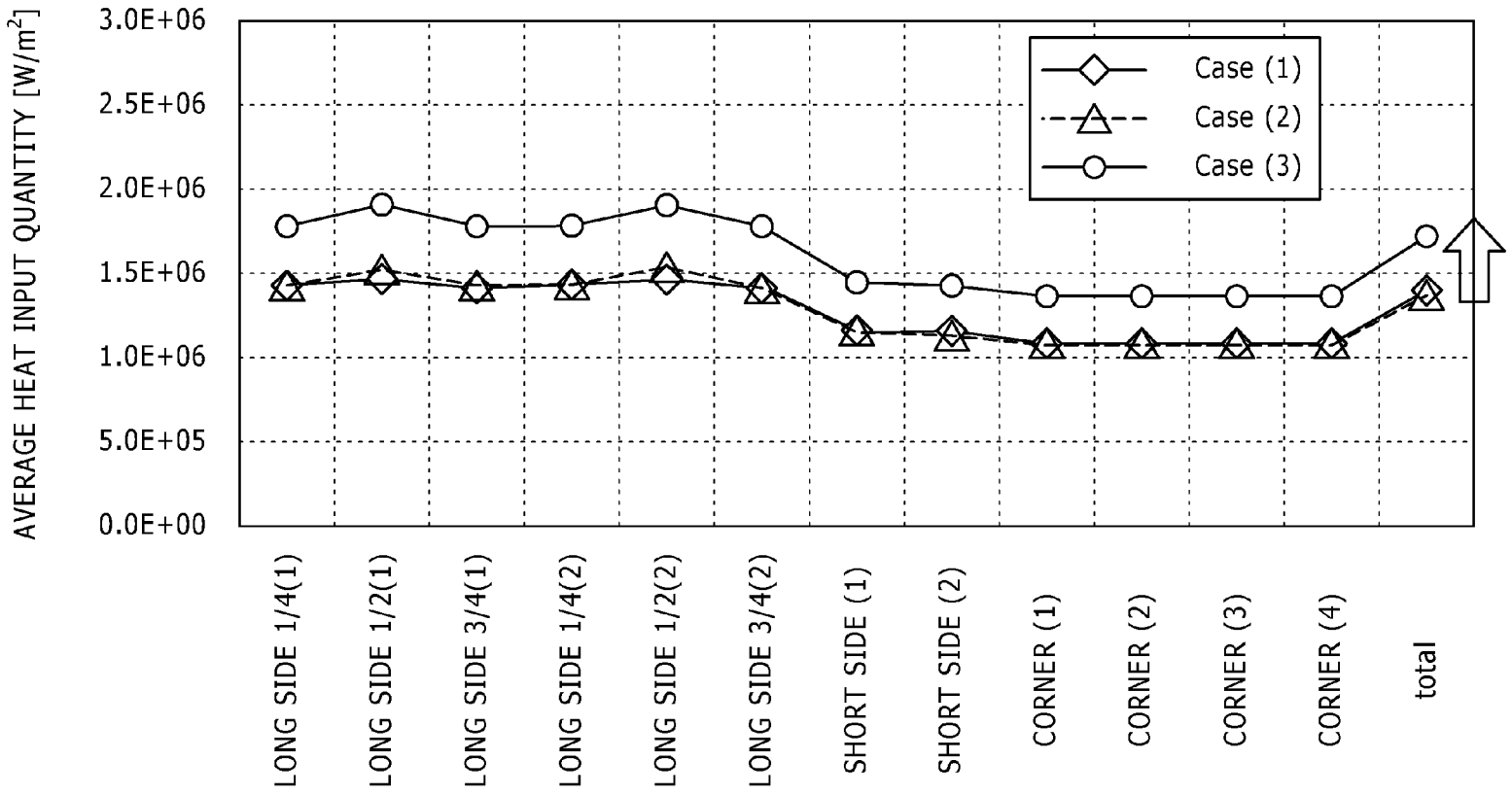
FIG. 12 is a graph showing an average heat input quantity at an individual portion resulting from dividing an initial solidification portion into a plurality of portions.

The average heat input quantity was calculated by flow and solidification calculation in order to obtain the slab 11 having an excellent casting surface over the entire periphery. The result is shown in FIG. 12. In this figure, Case (1) shows the average heat input quantities in a case where the slab 11 having a large size of 250 mm×1500 mm is cast using two plasma torches 7 each having an output of 750 kW, as shown in FIG. 5A. Further, Case (2) shows the average heat input quantities in a case where the slab 11 having a small size of 125 mm×375 mm is cast using the single plasma torch 7 having an output of 200 kW, as shown in FIG. 7A.

From FIG. 12, it was found that the slab 11 having an excellent casting surface over the entire periphery could be obtained by setting the average heat input quantity to 1.0 MW/m$^2$ or more and 2.0 MW/m$^2$ or less.

It is noted that, instead of the average heat input quantity, a slab average heat input quantity obtained by multiplying the average heat input quantity by a correction value may be used. The correction value herein is a value based on a length of the mold 2 surrounding a torch heating region. The torch heating region is a region of the melt surface of the molten metal 12, which is heated by the individual plasma torch 7.

As shown in FIG. 9, when the slab 11 having a large size is cast using two plasma torches 7, half of the melt surface of the molten metal 12 is the torch heating region 17 that is heated by each plasma torch 7. On the other hand, as shown in FIG. 10, when the slab 11 having a small size is cast using the single plasma torch 7, all the melt surface of the molten metal 12 is the torch heating region 17 that is heated by the plasma torch 7.

As shown in FIG. 9, when two plasma torches 7 are used, the torch heating region 17 is surrounded on its three sides with the mold 2. On the other hand, as shown in FIG. 10, when the single plasma torch 7 is used, the torch heating region 17 is surrounded on its four sides with the mold 2. Consequently, a cooling capacity of the mold 2 is larger in the torch heating region 17 surrounded on its four sides with the mold 2 than the one surrounded on its three sides with the mold 2. Thus, when the single plasma torch 7 is used, the slab average heat input quantity obtained by correcting the average heat input quantity with a correction value α is used. The correction value α is calculated from the following formula (1) using lengths of the long side 2W (mm) and the short side t (mm) of the mold 2 shown in FIG. 7A.

$$\alpha=(4W+2t)/(4W+t)=(375+125+375+125)/(375+125+375)=1.3 \quad \text{formula (1)}$$

In Case (2), when the output value of the plasma torch 7 is multiplied by the correction value α, the output becomes 250 kW. The slab average heat input quantities obtained by correcting the average heat input quantities in Case (2) with the correction value α are shown as Case (3) in FIG. 12. The growth of the solidified shell 13 near the melt surface of the molten metal 12 can be suitably suppressed by setting the slab average heat input quantity in each portion 15*a* to 1.0 MW/m$^2$ or more and 2.0 MW/m$^2$ or less. By this, the slab 11 having an excellent casting surface can be obtained.

(Molten Metal Advection Time)

The molten metal advection time is a time required for the molten metal 12 stirred electromagnetically to travel a length of the torch heating region 17 (torch effective heating width) along the long side direction of the mold 2. Specifically, the molten metal advection time is a value obtained by dividing the torch effective heating width by an average flow rate of the molten metal 12 while being transferred by electromagnetic stirring.

As shown in FIG. 9, when the slab 11 having a large size is cast, the torch heating region 17 of each plasma torch 7 is half of the melt surface of the molten metal 12. Thus, the torch effective heating width in this case is one half of the length of the long side of the mold 2. On the other hand, as shown in FIG. 10, when the slab 11 having a small size is cast, the torch heating region 17 of the plasma torch 7 is all the melt surface of the molten metal 12. Thus, the torch effective heating width in this case is the entire length of the long side of the mold 2.

The molten metal advection time Tm is calculated by Tm=L/Vm, where L represents the torch effective heating width and Vm represents the average flow rate of the molten metal 12 while traveling the torch effective heating width L by electromagnetic stirring.

Figure 13:
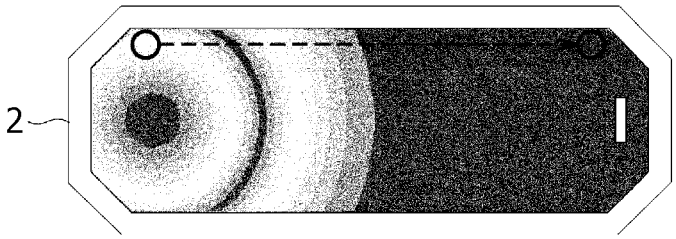
FIG. 13 is a model diagram of a mold, seen from above.

As shown in FIG. 13 depicting a model diagram of the mold 2 seen from above, when the plasma torch 7 moves on the melt surface to the left side of the figure, the melt surface of the molten metal 12 on the right side of the figure becomes apart from the plasma torch 7, thereby having a lower temperature. To prevent this, as shown by arrows, the melt surface of the molten metal 12 on the left side, having a higher temperature, is transferred to the melt surface on the right side by electromagnetic stirring. This mitigates the temperature drop of the molten metal 12 as compared to a case where the electromagnetic stirring is not performed and can thus uniformize the surface temperature of the slab.

However, as the molten metal advection time required for the molten metal 12 to travel the torch effective heating width varies, a degree of change in the surface temperature of the slab 11 over time also varies. Specifically, as the molten metal advection time becomes shorter, a temporal change of the surface temperature of the slab 11 becomes smaller, and eventually, the surface temperature of the slab 11 can be uniformized.

Remarkably, the surface temperature of the slab 11 can be uniformized by setting the molten metal advection time Tm to 3.5 sec or less.

(Flow and Solidification Calculation)

Figure 14:
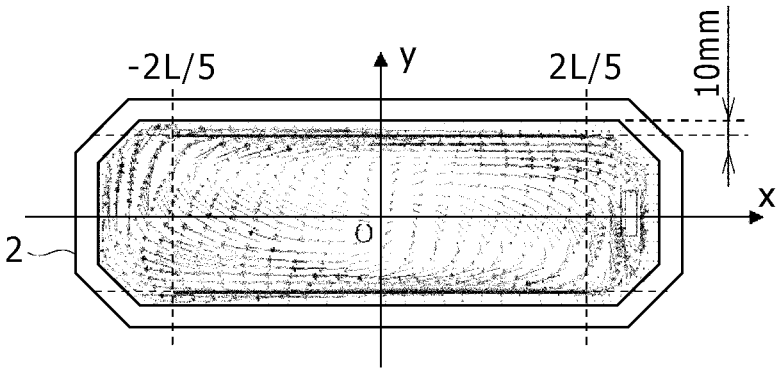
FIG. 14 is a model diagram of a mold, seen from above.

The molten metal advection time required for obtaining the slab 11 having an excellent casting surface over the entire periphery was calculated by flow and solidification calculation. In this calculation, as shown in FIG. 14 depicting a model diagram of the mold 2 seen from above, the molten metal advection time was obtained by using an average value of the flow rates (absolute values) in the x-axis direction in a range of $-2L/5 \leq x \leq 2L/5$ at positions 10 mm away from the inner surface of the mold 2.

Figure 15:
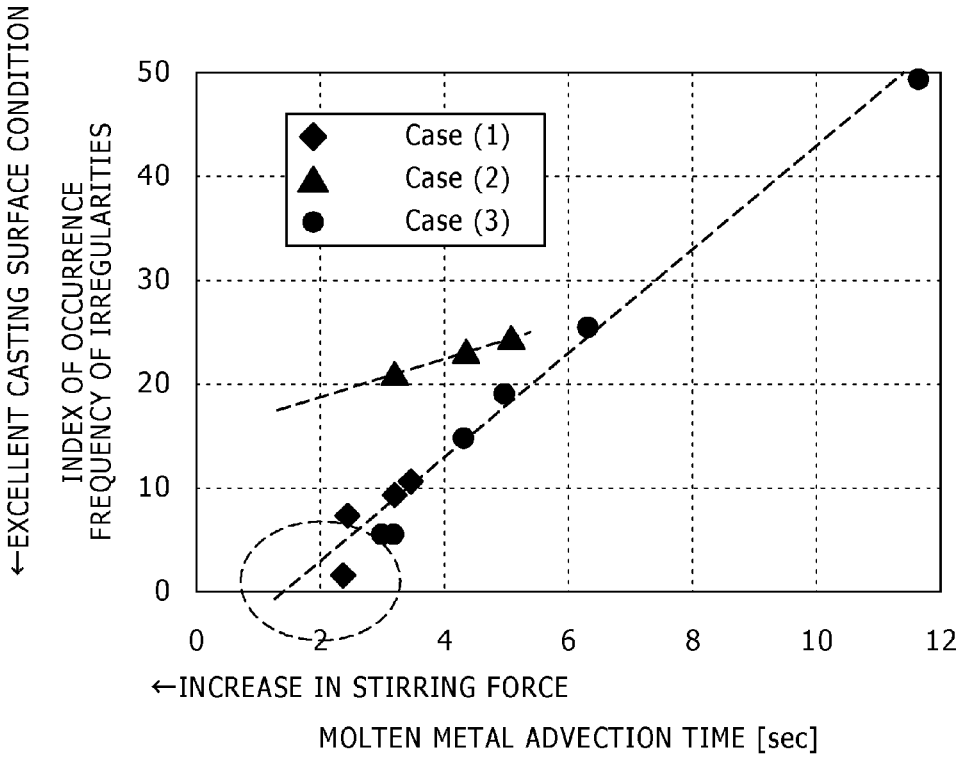
FIG. 15 is a graph showing a relation between a molten metal advection time and an index of occurrence frequency of irregularities.

FIG. 15 shows a relation between the molten metal advection time and an index of occurrence frequency of irregularities. In this figure, Case (1) represents calculation results in the case where the slab 11 having a large size of 250 mm×1500 mm was cast using two plasma torches 7 each having an output of 750 kW, as shown in FIG. 5A. Further, Case (2) represents calculation results in the case where the slab 11 having a small size of 125 mm×375 mm was cast using the single plasma torch 7 having an output of 200 kW, as shown in FIG. 7A. Finally, Case (3) represents calculation results of Case (2) after correcting the output value of the plasma torch 7 in Case (2) by the correction value to 250 kW.

Further, in this relation diagram, calculation results are plotted with respect to a stirring force of electromagnetic stirring while being changed. It is noted that as the stirring force of electromagnetic stirring becomes stronger, the flow rate of the molten metal 12 is increased more and the molten metal advection time is made shorter. Further, the smaller the index of occurrence frequency of irregularities is, the more the casting surface condition becomes excellent. Thus, a target range of the index of occurrence frequency of irregularities was set to 10 or less.

Based on FIG. 15, it was found that the slab 11 having an excellent casting surface over the entire periphery could be obtained by setting the molten metal advection time to 3.5 sec or less.

(Effects)

As described hereinabove, in the continuous casting device 1 for the slab made of titanium or a titanium alloy according to the present embodiment, the torch moving cycle representing a time required for the plasma torch 7 to complete a single round of movement in the predetermined moving pattern is set to 20 sec or more and 40 sec or less. This can reduce the nonuniformity caused by the temporal change and the spatial variation in the heat input quantity to the melt surface of the molten metal 12 due to a movement of the plasma torch 7. Further, the average heat input quantity to the individual portion 15*a* resulting from dividing the initial solidification portion 15 into the plurality of the portions 15*a* in the peripheral direction of the mold 2 is set to 1.0 $MW/m^2$ or more and 2.0 $MW/m^2$ or less. This can reduce the nonuniformity in the heat input quantity over the entire periphery of the peripheral parts of the melt surface of the molten metal 12. Further, the molten metal advection time representing a time required for the molten metal 12 to travel the length of the torch heating region 17 along the long side direction of the mold 2 is set to 3.5 sec or less. This can uniformize the surface temperature of the slab 11. By uniformizing the heat input quantity over the entire periphery of the peripheral parts of the melt surface of the molten metal 12 in this manner, it becomes possible to cast the slab 11 having an excellent casting surface condition.

(Modifications of the Present Embodiments)

The embodiments of the present invention are described hereinabove, however, it is obvious that the above embodiments solely serve as examples and are not to limit the present invention. The specific structures and the like of the present invention may be modified and designed according to the needs. Further, the actions and effects of the present invention described in the above embodiments are no more than the most preferable actions and effects achieved by the present invention, thus the actions and effects of the present invention are not limited to those described in the above embodiments of the present invention.

The present application is based on Japanese Patent Application (Japanese Patent Application No. 2014-83532) filed on Apr. 15, 2014, the contents of which are incorporated herein by reference.

EXPLANATION OF REFERENCE NUMERALS

1 Continuous casting device
2 Mold
7 Plasma torch
8 Electromagnetic stirring device
9 Controller
12 Molten metal

15 Initial solidification portion
15*a* Portions
17 Torch heating region

The invention claimed is:

1. A method for continuously casting a slab made of titanium or a titanium alloy with a continuous casting device, the continuous casting device comprising:

a plasma torch for heating a melt surface of a molten metal in a bottomless mold while moving over the melt surface of the molten metal in a predetermined moving pattern, the plasma torch being disposed above the bottomless mold;

an electromagnetic stirring device for stirring at least the melt surface of the molten metal by electromagnetic stirring, the electromagnetic stirring device being disposed on a side of the bottomless mold; and a controller, wherein the controller controls the plasma torch and the electromagnetic stirring device;

the method comprising:

injecting molten metal prepared by melting titanium or a titanium alloy into the bottomless mold having a rectangular cross section;

withdrawing the molten metal downward while being solidified; and controlling the plasma torch and the electromagnetic stirring device in accordance with:

a torch moving cycle T of 20 sec or more and 40 sec or less, the torch moving cycle T being a time required for the plasma torch to complete a single round of movement in the predetermined moving pattern and calculated by $T=4W/(A \cdot Vt)$, where 2W represents a length of a long side of the slab in a horizontal cross section, A represents the number of the plasma torch, and Vt represents an average moving speed of the plasma torch while moving in the predetermined moving pattern;

an average heat input quantity of 1.0 $MW/m^2$ or more and 2.0 $MW/m^2$ or less, the average heat input quantity being obtained by dividing an initial solidification portion, where the molten metal is initially solidified upon contacting with the bottomless mold, into a plurality of portions in a peripheral direction of the bottomless mold, and calculating an average of heat input quantities to each of the portions in a length direction of the corresponding portion along the bottomless mold; and a molten metal advection time Tm of 3.5 sec or less, the molten metal advection time being calculated by $Tm=L/Vm$, where L represents a length of a torch heating region along a long side direction of the bottomless mold, the torch heating region being a region of the melt surface of the molten metal, which is heated by the individual plasma torch, and Vm represents an average flow rate of the molten metal while traveling the length L by electromagnetic stirring, and representing a time required for the molten metal to travel the length L of the torch heating region along the long side direction of the bottomless mold.

* * * * *